United States Patent [19]

Matsui

[11] 4,430,919

[45] Feb. 14, 1984

[54] GUITAR BRIDGE

[75] Inventor: Kazuhiro Matsui, Toyoake, Japan

[73] Assignee: Hoshino Gakki Co., Ltd., Nagoya, Japan

[21] Appl. No.: 363,605

[22] Filed: Mar. 30, 1982

[30] Foreign Application Priority Data

Aug. 5, 1981 [JP] Japan ..... 56-116424[U]

[51] Int. Cl.³ ..... G10D 3/04

[52] U.S. Cl. ..... 84/299

[58] Field of Search ..... 84/298, 299, 307

[56] References Cited

U.S. PATENT DOCUMENTS

| | | | |
|---|---|---|---|
| 490,528 | 1/1893 | Wooster | 84/298 |
| 2,565,253 | 8/1951 | Melita | 84/298 |
| 2,740,313 | 4/1956 | McCarty | 84/307 |
| 4,135,426 | 1/1979 | Rickard | 84/1.16 |
| 4,334,454 | 6/1982 | Wall | 84/299 |

FOREIGN PATENT DOCUMENTS

| | | | |
|---|---|---|---|
| 10851 | of 1913 | United Kingdom | 84/299 |

*Primary Examiner*—Lawrence R. Franklin

*Attorney, Agent, or Firm*—Armstrong, Nikaido, Marmelstein & Kubovcik

[57] ABSTRACT

A guitar bridge provided with a saddle which is slidable on stepped elements mounted on the main body by the revolution of an adjusting screw. The saddle consists of two members—a string-receiving portion and a holding portion, and a screw means for integrally connecting the two members, the lower surface of both side ends of the string-receiving portion being engaged with the stepped elements mounted on the screw means.

3 Claims, 6 Drawing Figures

GUITAR BRIDGE

BACKGROUND OF THE INVENTION

1. Field of the Invention

The present invention relates to a guitar bridge, in particular to a guitar bridge provided with a saddle which is slidable on a stepped element, mounted on or formed into the main body, by the revolution of an adjusting screw.

2. Description of the Prior Art

As shown in FIGS. 1 to 3, a bridge 1 of a conventional electric guitar requiring the adjustment of pitch and height of string consists of a main body 10 provided with an opening 7 and stepped elements, or shoulders 3, 3 formed on both side upper ends thereof, an adjusting screw 2 mounted parallel to the shoulders 3, 3 in the opening 7 so that both ends thereof may be held on the main body 10 and a saddle 4, the upper portion projecting outwardly on both sides to form overhangs 4*a*. The saddle 4 is further formed with a threaded hole 4*b* extending through the lower portion thereof. The saddle 4 is connected with the adjusting screw 2 through the threaded hole 4*b*, the overhangs 4*a* of the saddle 4 resting upon and being supported by shoulders 3 of the main body at the lower surface thereof.

Accordingly, the fore and aft movements of the saddle 4 are carried out by sliding the overhangs 4*a*, 4*a* on the shoulders 3, 3 through the revolution of the adjusting screw 2.

The saddle 4 is not necessarily firmly fixed on the main body 10 of the bridge because the saddle 4 is merely subjected to a small downward pressure owing to the tension of a string 8. As a result, the vibration of the string 8 leads to the generation of gaps between the shoulders 3, 3 and the overhangs 4*a*, 4*a* of the saddle (FIG. 3) and thereby the vibration can not be surely transferred to the main body 10 of a bridge. In the case of an acoustic guitar and the like, in which the vibration of a string is transferred from the main body of a bridge to a receiving portion such as a resonance trunk and the like, such saddle movement also leads to the generation of chatter noise.

SUMMARY OF THE INVENTION

It is an object of the present invention to provide a guitar bridge which can firmly fix a saddle on the main body thereof, giving no influences upon the vibration of a string, and surely transferring the vibration of a string to a receiving portion of a guitar body.

It is another object of the present invention to provide a guitar bridge comprising a saddle consisting of two detachable members—a string-receiving portion and holding portion wherein the string-receiving portion and the holding portion are integrally connected by a screw means.

The present invention relates to a guitar bridge provided with a saddle, which is slidable on shoulders formed on the main body by the revolution of an adjusting screw wherein the saddle consists of two members—a string-receiving portion and a holding portion, screw means for integrally connecting the two members, and the string-receiving portion is engaged with the shoulder by the screw means at the lower surface of both side ends thereof.

DESCRIPTION OF THE PREFERRED EMBODIMENT

Figure 1:
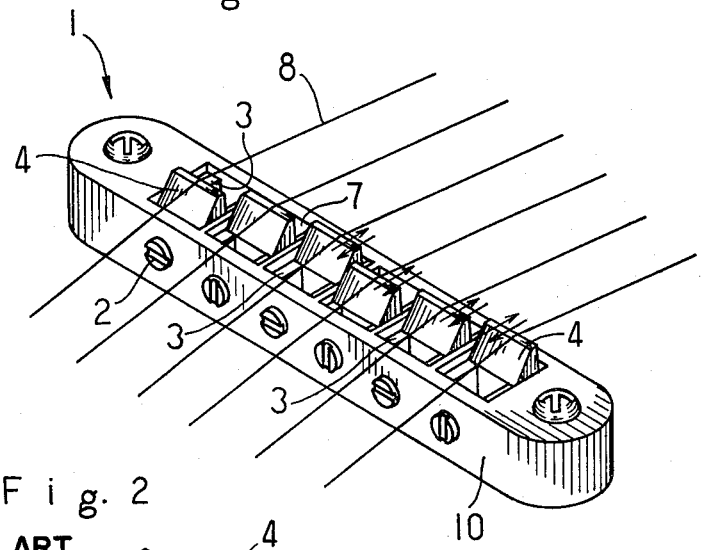
Fig. 1 PRIOR ART
FIG. 1 is a perspective view showing a conventional bridge.
Figure 2:
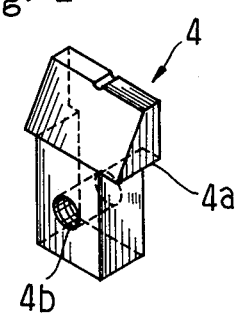
Fig. 2 PRIOR ART
FIG. 2 is a perspective view showing a conventional saddle.
Figure 3:
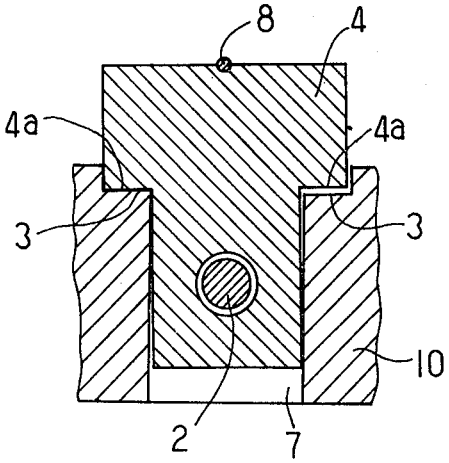
Fig. 3 PRIOR ART
FIG. 3 is a partial cross section of FIG. 1 taken through a bridge in the transverse direction.
Figure 4:
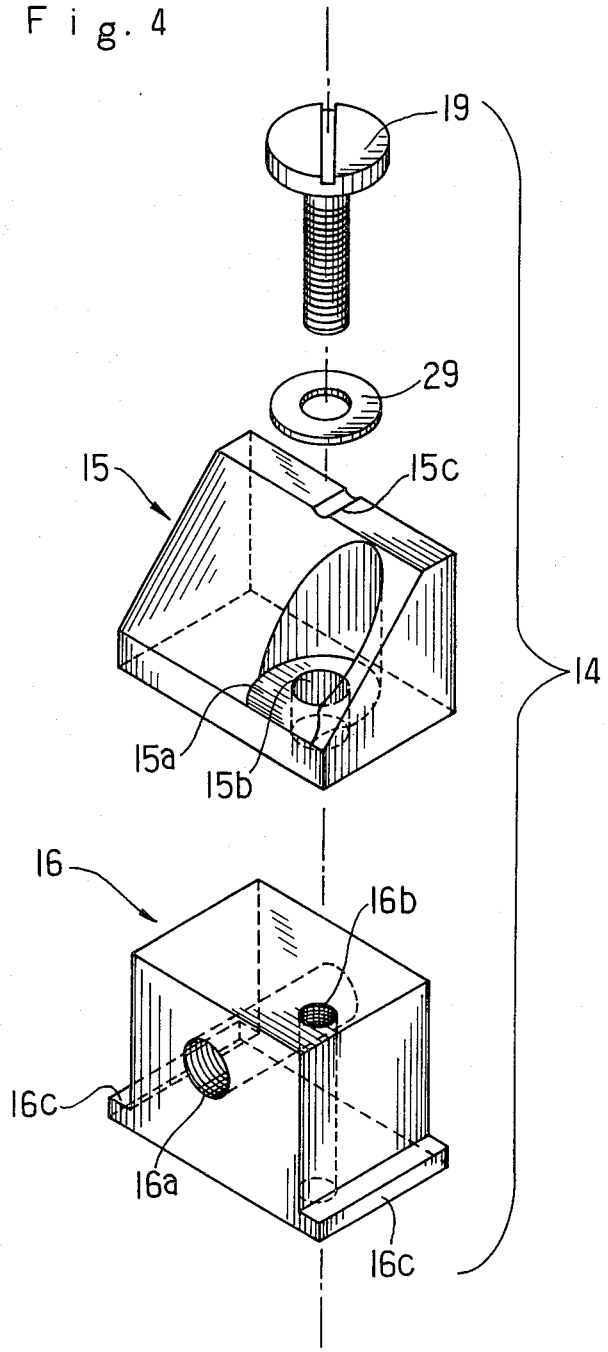
FIG. 4 is an exploded perspective view showing a preferred embodiment of a saddle according to the present invention.

Referring now to FIG. 4, a saddle 14 consists of a string-receiving portion 15, a holding portion 16, a holding screw 19 and a washer 29.

The string-receiving portion 15 has a sloping aft side and a longitudinal cross-sectional shape corresponding to a right trapezoid, the right angle being at the forward end of the base of the triangle. The term "forward" is used in relation to its mounting position in the bridge when the bridge is mounted on a guitar, the bridge being mounted in the transverse direction and the strings of the guitar in the longitudinal or fore-and-aft direction. The string-receiving portion 15 is provided with a concave portion 15*c* for receiving a string on the upper surface thereof, a receiving surface 15*a* supporting a washer 29 and the head of a screw 19 and a bore 15*b* for passing the screw 19 therethrough. The receiving surface 15*a* is formed by boring a hole down through the sloping side of the string-receiving portion 15 to the level of the truncated section.

The holding portion 16 having a nearly rectangular shape is provided with a flange portion 16*c* formed on both sides of the lower portion thereof. The holding portion 16 is provided with a hole 16*a* threaded horizontally to receive an adjusting screw 12 and a second hole 16*b* threaded vertically to receive holding screw 19.

The string-receiving portion 15 has a width of such extent that both the ends of the lower surface thereof rest on shoulders 13, 13 of the main body 20 of the bridge. The holding portion 16 has a size of such the extent that the upper portion thereof can slide within an opening 17 of the main body 20 of the bridge and the lower portion, i.e., the flange portion 16*c* thereof has a transverse dimension larger than that of the opening 17.

The string-receiving portion 15 is integrally connected with the holding portion 16 by passing the holding screw 19 through the bore 15*b* of the string-receiving portion 15 to engage with the threaded hole 16*b* of the holding portion 16.

Figure 5:
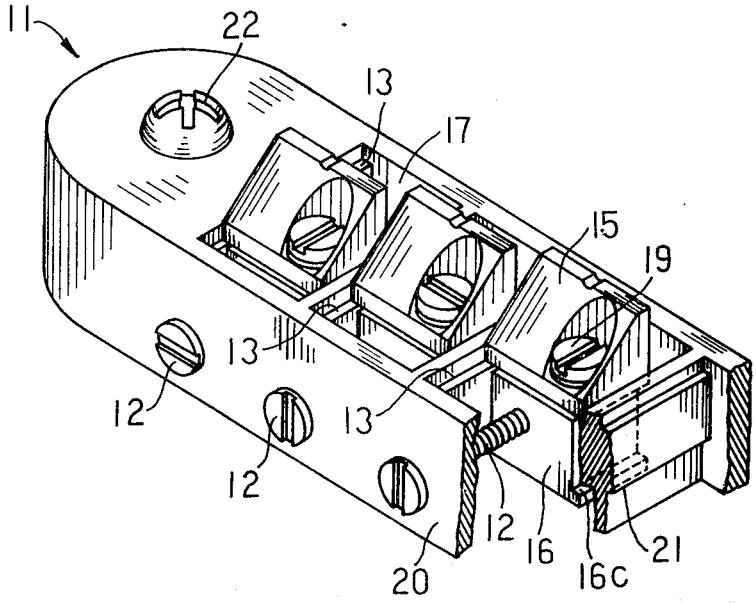
FIG. 5 is a partial perspective view showing saddles mounted in a guitar bridge according to the present invention.
Figure 6:
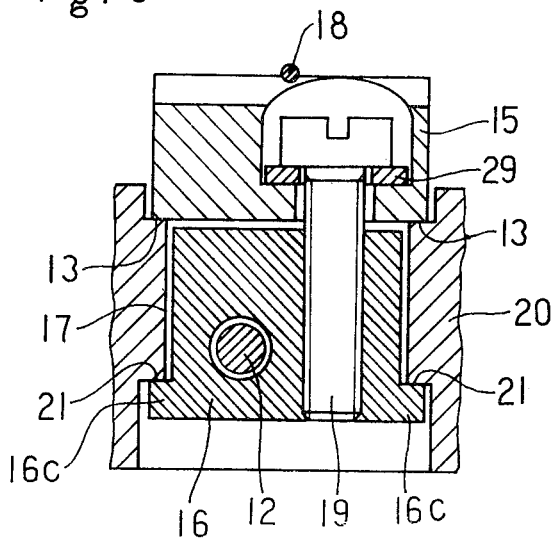
FIG. 6 is a partial cross section of FIG. 5 taken through a bridge in the transverse direction.

As shown in FIGS. 5 and 6, the main body 20 of a bridge 11 is provided with a predetermined number of openings 17, one for each saddle, having upper shoulders 13, 13 on both side upper ends thereof and lower shoulders 21, 21 on both side lower ends thereof. Adjusting screws 12 extend through holes in both sides of the main body 20 in the fore-and-aft direction and through each of the openings 17 of the main body 20. The bridge 11 is firmly fixed on a guitar body by means of a screw 22 at each end of the bridge.

Accordingly, the bridge 11 has a construction in which the adjusting screw 12 is held on the main body 20, the holding portion 16 being connected with the adjusting screw 12, the string-receiving portion 15 being connected with the holding portion 16 through the holding screw 19, and the lower surface of both side ends of the string-receiving portion 15 being engaged with the upper shoulders 13 of the main body 20 while the upper surface of the flanges at both side ends of the holding portion 16 are engaged with the lower shoulders 21 of the main body 20.

Fore-and-aft movement of the string-receiving portion 15 and the holding portion 16 for adjusting pitch and height of strings is carried out by loosening the holding screw 19, rotating the adjusting screw 12 to move the string-receiving portion 15 and the holding portion 16 to a desired position, and tightening the holding screw 19 again.

The lower surface of both side ends of the string-receiving portion 15 is engaged with, i.e., maintained in contact with, shoulders 13 of the main body 20 and simultaneously the upper surface of the flanges at both side ends of the holding portion 16 is maintained in firm contact or engaged with the shoulders 21 of the main body 20 by tightening the holding screw 19 whereby the projecting portion of the main body 20 which forms the shoulders 13 and 21 is firmly sandwiched between the string-receiving portion 15 and the holding portion 16 as shown in FIG. 6.

Alternatively, the saddle may be constructed so that shoulders 13 may be engaged with the lower surface of a flange portion formed on the upper portions of both sides of the string-receiving portion 15 and the string-receiving portion 15 provided with a trunk portion, which is slidable inside the opening 17 and has a threaded hole to receive the adjusting screw 12 and the holding portion 16 serving mainly for holding the string-receiving portion in firm contact with the main body.

In addition, it is not always necessary that the holding portion 16 be provided with the flange portion if the adjusting screw 12 is made of bending resistant materials.

What is claimed is:

1. A guitar bridge comprising:

a main body having a plurality of transversely spaced openings formed therein for receiving a plurality of longitudinally adjustable saddles, each of said openings having upper shoulders formed in the side upper ends and lower shoulders formed in the side lower ends, each of said saddles being positioned in a corresponding one of said openings wherein each of said saddles comprises a string receiving portion and a holding portion, said string receiving portion having a concave impression in its upper surface adapted to receive a guitar string, and having its lower surface engaged with and supported by said upper shoulders, said holding portion fitting within said opening and having laterally extending flange portions resting on said lower shoulders, said holding portion having a threaded hole extending therethrough for receiving an adjusting screw;

an adjusting screw extending in a fore-and-aft direction through said opening and through said threaded hole and operable, upon rotation, to adjust the position of said saddle in a fore-and-aft direction, and to maintain said saddle in its adjusted position; and a holding screw passing through said string-receiving portion and said holding portion, connecting said portions and operable upon tightening of said holding screw to maintain said string-receiving portion and said holding portion in firm contact with said upper shoulders and lower shoulders, respectively, to prevent undesired lateral or rotational movement of said saddle.

2. A guitar bridge having a main body formed with a plurality of openings, each of said openings having upper and lower shoulders on the sides thereof, an adjusting screw extending in a fore-and-aft direction through one of said openings;

a saddle positioned in said one opening and having a string-receiving portion and a holding portion, said string-receiving portion having its lower surface positioned on said upper shoulders for sliding movement thereon, and having a concavity in its upper surface for receiving a guitar string, said holding portion being positioned within said opening and having flanges at its lower portion for engaging said lower shoulders, and having a threaded hole extending therethrough for receiving said adjusting screw, whereby rotation of said adjusting screw will cause fore-and-aft movement of said holding portion; and a holding screw connecting said string-receiving portion to said holding portion for movement therewith, and arranged so that tightening of said holding screw will maintain said holding portion and said string-receiving portion in firm contact with said lower and upper shoulders, respectively, to prevent vibration of said saddle.

3. A guitar bridge having a main body formed with a plurality of openings, each of said openings having upper and lower shoulders disposed at both sides thereof, an adjusting screw extending in a fore-and-aft direction through one of said openings;

a saddle positioned in said one opening and having a string-receiving portion and a holding portion, said string-receiving portion having a lower surface adapted to ride on said upper shoulders for sliding movement thereon, and having a concavity in its upper surface for receiving a guitar string, said holding portion having an upper surface adapted to engage said lower shoulders;

a holding screw connecting said string receiving portion to said holding portion for movement therewith, and arranged so that tightening of said holding screw will maintain said string-receiving portion and said holding portion in firm contact with said upper and lower shoulders, respectively, to prevent vibration of said saddle; and a threaded hole extending through a portion of said saddle for receiving said adjusting screw, whereby rotation of said adjusting screw will effect fore-and-aft movement of said saddle.

* * * * *